US005412301A

United States Patent [19]

Jornot et al.

[11] Patent Number: 5,412,301

[45] Date of Patent: May 2, 1995

[54] DRIVE FOR A DRAFTING ARRANGEMENT

[75] Inventors: Erich Jornot; Urs Keller, both of Seuzach, Switzerland

[73] Assignee: Maschinenfabrik Rieter AG, Winterthur, Switzerland

[21] Appl. No.: 176,699

[22] Filed: Jan. 3, 1994

Related U.S. Application Data

[63] Continuation of Ser. No. 729,328, Jul. 12, 1991, abandoned.

[30] Foreign Application Priority Data

Jul. 13, 1990 [CH] Switzerland ..... 02357/90

[51] Int. Cl.[6] ..... G06F 15/46; G01D 3/04; D01H 5/32

[52] U.S. Cl. ..... 318/640; 318/696; 318/34; 19/240; 19/239

[58] Field of Search ..... 318/1–10, 318/30–88, 560–646; 19/0.39, 0.56, 0.58, 150–300; 51/264, 58.36, 58.61, 58.83, 58.84, 92, 93, 94, 95, 81, 100

[56] References Cited

U.S. PATENT DOCUMENTS

| | | | |
|---|---|---|---|
| 3,678,673 | 7/1972 | Prochazka et al. | 57/58.95 |
| 3,699,421 | 10/1972 | Stempler et al. | 318/640 |
| 3,715,643 | 2/1973 | Masaki | 318/466 |
| 3,925,850 | 12/1975 | Lytton | 19/240 X |
| 3,958,305 | 5/1976 | Felix et al. | 19/215 |
| 4,038,723 | 8/1977 | Felix | 19/215 |
| 4,209,778 | 6/1980 | Wehde et al. | 57/264 |
| 4,215,302 | 7/1980 | Chiang | 318/696 |
| 4,336,684 | 6/1982 | Hartmannsgruber et al. | 57/93 |
| 4,339,700 | 7/1982 | Desbiens et al. | 318/660 |
| 4,369,550 | 1/1983 | Meile | 19/240 |
| 4,460,852 | 7/1984 | Kondo et al. | 318/67 |
| 4,473,924 | 10/1984 | Hartmannsgruber et al. | 19/239 |
| 4,494,204 | 1/1985 | Hosel | 19/240 X |
| 4,506,197 | 3/1985 | Kondo et al. | 318/34 |
| 4,506,414 | 3/1985 | Krieger | 19/240 |
| 4,512,061 | 4/1985 | Hartmannsgruber et al. | 19/239 |
| 4,558,265 | 12/1985 | Hayashida et al. | 318/561 |
| 4,589,168 | 5/1986 | Krieger | 19/240 |
| 4,653,153 | 3/1987 | Felix et al. | 19/240 |
| 4,661,756 | 4/1987 | Murphy et al. | 318/701 |
| 4,703,431 | 10/1987 | Sako et al. | 19/240 X |
| 4,772,839 | 9/1988 | MacMinn et al. | 318/696 |
| 4,812,993 | 3/1989 | Konig et al. | 19/239 X |
| 4,819,301 | 4/1989 | Konig et al. | 19/240 |
| 4,864,694 | 9/1989 | Konig et al. | 19/240 |
| 4,888,509 | 12/1989 | Tomasek | 310/42 |
| 4,987,734 | 1/1991 | Meyer | 19/258 X |

FOREIGN PATENT DOCUMENTS

| | | | |
|---|---|---|---|
| 38927 | 11/1981 | European Pat. Off. | D01H 5/42 |
| 141505 | 5/1985 | European Pat. Off. | D01H 5/42 |
| 300123 | 1/1989 | European Pat. Off. | H02K 29/06 |
| 355557 | 2/1990 | European Pat. Off. | D01H 1/32 |
| 2650287 | 5/1978 | Germany | D01H 5/38 |

*Primary Examiner*—Paul Ip

*Attorney, Agent, or Firm*—Sandler Greenblum & Bernstein

[57] ABSTRACT

An individual regulation circuit is provided for each position-regulated drive motor for a textile machine, such as drafting arrangement. It is contemplated by the invention to have each such regulation circuit encompass a position sensor which also can deliver a position signal during standstill of the motor shaft of the associated drive motor.

12 Claims, 4 Drawing Sheets

DRIVE FOR A DRAFTING ARRANGEMENT

This application is a continuation of application Ser. No. 07/729,328, filed Jul. 12, 1991, now abandoned.

BACKGROUND OF THE INVENTION

1. Field of the Invention

The present invention relates to a new and improved drive for a textile machine. The invention of the present development is particularly advantageous for use in conjunction with drafting arrangements or units in so-called preparatory departments of spinning mills, for example, in draw frames or combing machines.

2. Discussion of the Background and Material Information

It is known for quite some time in the textile art to compensate, especially at so-called autoleveller draw frames, fluctuations in the mass of a sliver which is subsequently to be spun by the controlled alteration of the draft in a draw frame.

In this connection it is also known that the most difficult problems of the process arise during the run-up-to-speed or start-up and the braking of the draw frame. The significance of such run-up-to-speed and braking or stopping of the draw frame increases with ever increasing delivery velocities or speeds, with increasing productivity, of the relevant machine. With a normal delivery velocity or speed of 800 m/min. the run-up-to-speed and braking intervals, respectively, for a draw frame amounts to approximately 1 to 3 seconds. If there is produced a faulty sliver within this time interval because of problems which have arisen in a regulation circuit of the draw frame, then these faults or defects in the sliver, during the subsequent spinning of a fine yarn, can detrimentally affect a yarn length of about 700 to 2000 meters.

The sliver which is processed in the draw frame must be deposited into a so-called can so that such sliver can be transported between different processing stages. After the filling of a can with sliver the draw frame must be briefly stopped in order to exchange the filled can for an empty can, thus requiring a braking interval followed by a run-up-to-speed interval at the draw frame.

German Patent Publication No. 2,650,287, published May 3, 1978, identified the problems of the run-up-to-speed and braking times of a draw frame. However, the solutions proposed therein are exclusively concerned with the transition between the run-up-to speed and the normal operation of the draw frame and the transition between the normal operation and the braking or bringing to standstill of the draw frame. Furthermore, it has been assumed that the sliver draft can be maintained constant during the run-up-to-speed and braking of the draw frame.

In the commonly assigned European Patent No. 0,038,927, published Nov. 4, 1981, there was recognized the necessity of continuing to regulate the sliver draft also during the run-up-to-speed and braking phases of the draw frame. Indeed, it was necessary to increase the "inertia" of the regulation circuit during the run-up-to-speed and braking of the draw frame, in order to overcome regulation problems. This solution mitigates the effects of the total problem without, however, eliminating the same.

European Patent No. 0,141,505, published May 15, 1985, also addresses these problems. The proposed solution suggests that at the "worst" operating times, namely, just prior to and after standstill of the machine, the drive system should be "suddenly" started and stopped, respectively.

It is also known from the commonly assigned European Patent No. 0,355,557, published Feb. 28, 1990, to individually drive the cylinders of a drafting arrangement by position-regulated motors. Amplification of this concept for the drive of a draw frame also has been disclosed in the commonly assigned, copending U.S. application Ser. No. 07/885,245, filed May 20, 1992 and entitled "DRAFTING ARRANGEMENT WITH FEEDBACK DRIVE GROUPS", to which reference may be readily had and the disclosure of which is incorporated herein in its entirety by reference.

SUMMARY OF THE INVENTION

Therefore, with the foregoing in mind, it is a primary object of the present invention to provide an improved drive for a drafting arrangement which is not afflicted with the aforementioned shortcomings and drawbacks of the prior art.

Another and more specific object of the present invention aims at further developing the aforementioned concept such that there can be predetermined the behavior of the drive system up to and from standstill of the draw frame.

Now in order to implement these and still further objects of the present invention, which will become more readily apparent as the description proceeds, the drive for a drafting arrangement of the present development contains a position-regulated motor and is manifested, among other things, by the features that the regulation circuit for regulation of the position-regulated motor comprises a position sensor which can deliver a signal corresponding to the angular position of the motor armature of the position-regulated motor even during standstill of the motor armature.

According to the invention, the regulation circuit also can encompass an evaluation of the position signal which can derive a rotational-speed dependent signal from changes in the position signal. The present invention also can be employed in those situations where there is present only one drive motor and, under these circumstances, it renders possible a very accurate run-up-to-speed and braking of this drive motor. However, the present invention also can be particularly advantageously used in those situations where there are present two or more drive motors, and each drive motor has operatively correlated therewith its own regulation circuit. In such an arrangement the mutual behavior of the rotational speeds of the regulated drive motors can be exactly determined also up to and from standstill of these drive motors.

The position sensor advantageously comprises an electromagnetic sensor. This electromagnetic sensor can encompass means for generating an electromagnetic field, and this electromagnetic field has a preferred spatial direction. This electromagnetic-field generator means is preferably mounted upon the shaft of the associated drive motor or can be connected with the motor armature, so that the angular position of the preferred field direction alters during rotation of the motor armature about the lengthwise axis or axis of rotation of the motor armature. The position sensor further can comprise a plurality of field sensors which are distributed about the motor shaft and react with a predetermined phase shift to the rotating electromagnetic field. The electromagnetic field is preferably excitable by alternating-current, so that as a result a position signal also can be obtained from the field sensors during standstill of the motor armature.

Upon excitation of the electromagnetic field the position sensor preferably continuously delivers a position signal, namely an analog signal, and there also could be used a quasi-continuous position signal (with such a higher scanning or sampling frequency that the evaluation would not be affected by the discontinuity of the position signal). Nevertheless, the evaluation is preferably based upon digital technology, so that an analog-digital converter should be provided between the position sensor and the evaluation device. The scanning or sampling rate of the analog-digital converter should be selected as a function of the delivery speed and the properties of the sliver to be drafted such that there do not arise any regulation problems, such as, for instance, oscillations, in the employed regulation circuits. The optimum scanning rate only can be determined as a function of the desired operating conditions, but usually there is required a scanning frequency greater than 2500 Hz.

BRIEF DESCRIPTION OF THE DRAWINGS

The invention will be better understood and objects other than those set forth above, will become apparent when consideration is given to the following detailed description thereof. Such description makes reference to the annexed drawings wherein, initially, the drive concept will be explained for the sake of completeness in understanding based upon the aforementioned prior filed, commonly assigned, U.S. application Ser. No. 07/885,245, filed May 20, 1992, now Pat. No. 5,248,925 and in conjunction with FIGS. 1 and 2 and wherein.

DETAILED DESCRIPTION OF THE PREFERRED EMBODIMENTS

Describing now the drawings, it is to be understood that only enough of the construction of the drive for a drafting arrangement and the related structure have been depicted therein, in order to simplify the illustration, as needed for those skilled in the art to readily understand the underlying principles and concepts of the present invention.

Figure 1:
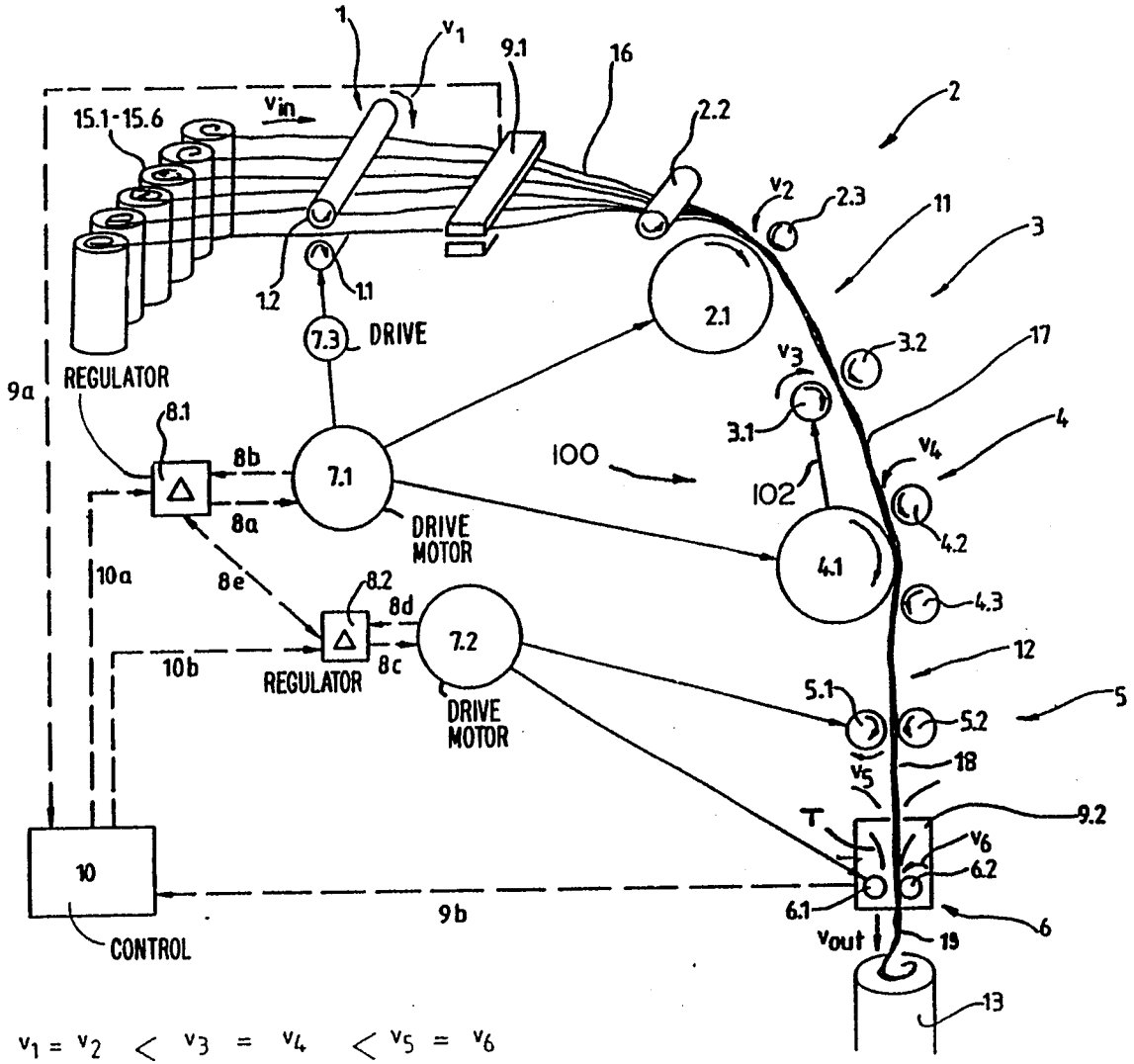
FIG. 1 schematically illustrates a drive system for a draw frame in accordance with the just mentioned commonly assigned, U.S. application Ser. No. 07/885,245 filed May 20, 1992, now U.S. Pat. No. 5,248,925

Turning attention now to the drawings, FIG. 1 schematically depicts an exemplary embodiment of a draw frame 100. In the commonly assigned, U.S. application Ser. No. 07/455,992, filed Dec. 22, 1989, now abandoned, and entitled "COMBING MACHINE AND PROCESS FOR FORMING AN EVEN COMBED SLIVER", to which reference may be readily had and the disclosure of which is likewise incorporated herein in its entirety by reference, there is disclosed the use of an autoleveller or regulated drafting arrangement in a combing machine. The principles and systems described hereinafter are equally useable both in a combing machine and a draw frame.

Turning attention now to the drive system for a draw frame as depicted in FIG. 1, it will be understood that a plurality of slivers 15.1 to 15.6, in the embodiment under consideration six slivers, are combined or grouped together to form a loose fiber web 16. Since the peripheral velocity of the rolls, in the direction of transport of the fiber material, increases in two stages, the fiber material experiences a preliminary draft in the first stage and in the second stage such fiber material is further drafted to possess the desired cross-section, and thus, experiences a main draft.

The web 18 departing from the draw frame 100 is thinner than the web 16 formed from the infed slivers 15.1 to 15.6 and correspondingly longer. Since the drafting operations can be regulated as a function of the cross-section of the infed slivers 15.1 to 15.6, these slivers and the web formed therefrom, respectively, are evened or levelled during passage through the draw frame 100, in other words, the cross-section or cross-sectional area of the departing web 18 is more uniform than the cross-section or cross-sectional area of the infed slivers 15.1 to 15.6 and the formed web 16, respectively. The depicted draw frame 100 comprises a preliminary drafting zone or region 11 and a main drafting zone or region 12. However, it is to be specifically understood that the teachings of the present invention also can be used in analogous fashion in conjunction with draw frames having only one or more than two drafting zones.

The slivers 15.1 to 15.6 are delivered through the draw frame 100 by two roll systems 1 and 2 composed of feed or conveyor rolls 1.1, 1.2 and 2.1, 2.2 and 2.3, respectively. The first roll system 1 comprises, for example, two rolls 1.1 and 1.2 between which there are transported the infed slivers 15.1 to 15.6 which are combined to form the loose web 16. In the direction of transport of the slivers 15.1 to 15.6 there follows the second roll system 2 which here, for example, comprises an active, that is, a power-driven feed or conveyor roll 2.1 and two passive feed or conveyor rolls 2.2 and 2.3. As previously explained, during the infeed of the textile material through the two roll systems 1 and 2, the infed or delivered slivers 15.1 to 15.6 are grouped together or combined adjacent one another to form the loose fiber web 16. The peripheral velocities $v_1$ and $v_2$ ($=v_m$) of all of the rolls 1.1, 1.2 and 2.1, 2.2 and 2.3 of both of the roll systems 1 and 2, respectively, are of the same magnitude, so that the thickness of the web 16 essentially corresponds to the thickness of the infed slivers 15.1 to 15.6.

A third roll system 3 of the textile material infeed system follows both of the roll systems 1 and 2 in the depicted direction of transport of the web 16. This third roll system 3 comprises, for example, preliminary draft rolls 3.1 and 3.2 between which the web 16 is further transported. The peripheral velocity $v_3$ of these preliminary draft rolls 3.1 and 3.2 is greater than the peripheral velocity $v_1$ and $v_2$ of the feed or infeed rolls 1.1, 1.2 and 2.1, 2.2 and 2.3, respectively, so that the web 16 is drafted in the preliminary drafting zone 11 between the infeed system 2 and the preliminary draft-roll system 3. As a result, the cross-section of the web 16 is reduced. At the same time there is produced from the loose web 16 composed of the infed slivers 15.1 to 15.6 the preliminarily drafted or pre-drafted web 17.

A further roll system 4 follows the preliminary draft-roll system 3. This further roll system 4 is composed of, for example, an active, that is, a power-driven feed or conveyor roll 4.1 and two passive feed or conveyor rolls 4.2 and 4.3 serving for the further transport or conveyance of the web 17. The peripheral velocity of these feed or conveyor rolls 4.1, 4.2 and 4.3 of the further roll system 4 is the same as the peripheral velocity $v_3$ of the preliminary draft rolls 3.1 and 3.2 of the third roll system 3.

A fifth roll system 5 follows the fourth roll system 4 in the transport direction of the web 17. This fifth roll system 5 comprises, for example, the main draft rolls 5.1 and 5.2. These main draft rolls 5.1 and 5.2 possess a greater peripheral or surface velocity $v_5$ than the preceding considered transport or feed rolls 4.1, 4.2 and 4.3, so that the pre-drafted web 17 is further drafted between the feed or conveyor rolls 4.1, 4.2 and 4.3 of the further roll system 4 and the main draft rolls 5.1 and 5.2 of the main draft roll system 5 in the main drafting zone or region 12 so as to form the finished or finally drafted web 18. This finished drafted web 18 is grouped together or condensed into a sliver 19 by means of a funnel or condenser T.

The finally drafted sliver 19 is removed from the draw frame 100 between a pair 6 of delivery or outfeed rolls 6.1 and 6.2, the peripheral velocity $v_6$ ($=v_{out}$) of each of which is equal to the peripheral or surface velocity $v_5$ of the upstream arranged main draft rolls 5.1 and 5.2 of the main draft roll system 5. After such removal of the finally drafted sliver 19 from the draw frame 100 it is deposited in the form of coils or loops in a rotating can 13, as is well known in the textile art.

The roll systems 1, 2 and 4 are driven by a first servo-motor or drive motor 7.1, preferably by means of a suitable transmission composed of toothed belts. The preliminary draft rolls 3.1 and 3.2 of the third roll system 3 are mechanically coupled, as generally indicated by reference character 102, with the further roll system 4, and the transmission ratio can be adjusted or set, in other words, there can be inputted a reference or set value. The transmission (not shown in the drawing) determines the speed ratio of the peripheral velocities of the infeed rolls ($v_m$) and the peripheral velocity $v_3$ of the preliminary draft rolls 3.1 and 3.2, that is to say, the preliminary or pre-draft ratio.

The roll systems 5 and 6 are driven, in turn, by a second servo-motor or drive motor 7.2. The feed or infeed rolls 1.1 and 1.2 can be driven by the first servo-motor 7.1 or optionally by means of an independent drive motor 7.3. Each of the servo-motors 7.1 and 7.2 are provided with their own regulator or controller 8.1 and 8.2, respectively. The regulation process takes place in each instance by means of a closed regulation circuit **8*a*, 8*b* and 8*c*, 8*d*, respectively. Additionally, the actual value of one servo-motor 7.1 or 7.2 can be transmitted to the other servo-motor 7.2 or 7.1, respectively in either of both directions by means of a control connection 8*e*, so that each servo-motor 7.1 or 7.2 can appropriately respond to deviations of the other servo-motor 7.2 or 7.1**, respectively.

An infeed measuring element 9.1 measures, at the inlet or inlet side of the draw frame 100, the mass of the infed slivers 15.1 to 15.6 or a magnitude proportional to the mass, such as the cross-section of the infed slivers 15.1 to 15.6. At the outlet or outlet side of the draw frame 100 there is measured the cross-section of the emerging or departing sliver 19 by means of an outlet measuring element 9.2.

A central computer or control unit 10 transmits an initial setting of the reference or set value for the first servo-motor or drive motor 7.1 by means of the line or path **10*a* to the first regulator 8.1. The measured values of both measuring elements 9.1 and 9.2 are continuously transmitted during the drafting process by means of the connections or paths 9*a* and 9*b* to the central computer or control unit 10. The set or reference value for the servo-motor or drive motor 7.2 is established in the central computer or control unit 10 from these measuring results and from the set value for the cross-section of the emerging sliver 19 and possibly provided further elements. This set or reference value is continuously transmitted by means of the line or path 10*b* to the second regulator 8.2. By means of this regulation system, the so-called "main regulation", there can be compensated fluctuations in the cross-section of the infed slivers 15.1 to 15.6** by appropriately regulating the main drafting process and there can be realized an evening or levelling of the sliver.

Figure 2:
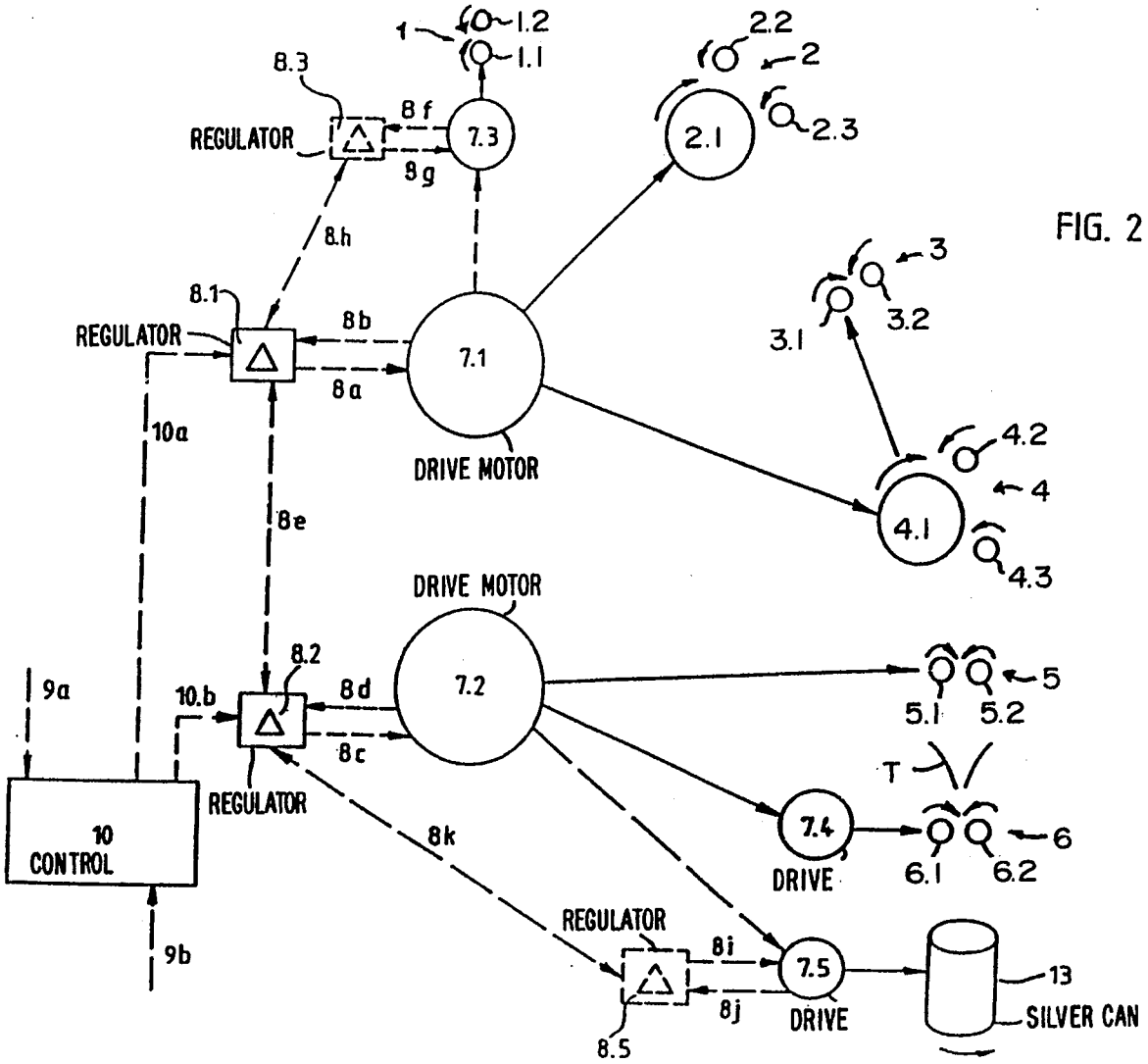
FIG. 2 schematically illustrates details of the drive arrangement and the appropriate regulators of a draw frame according to FIG. 1.

Based upon the showing of FIG. 2 there now will be more fully explained the drive concept of an arrangement according to FIG. 1 together with its regulation. As the main drive there primarily serve both of the servo-motors or drive motors 7.1 and 7.2. The servo-motor 7.1 drives the roll systems 1 and 2 of the infeed arrangement and the roll system 4 containing the feed or conveyor rolls 4.1, 4.2 and 4.3 which follow the preliminary draft or drafting zone 11. The pair of preliminary drafting rolls 3.1 and 3.2 of the roll system 3 is mechanically coupled, as previously indicated by reference numeral 102, with the roll system 4, in other words, is likewise driven by the servo-motor 7.1. The pair of rolls 1.1 and 1.2 of the roll system 1 at the inlet of the draw frame 100 is either driven by an intermediate drive 7.3 (transmission) by the servo-motor 7.1 or, according to a different embodiment of the draw frame drive, can be driven by an independent servo-motor 7.3. The servo-motor 7.2 directly drives the main drafting rolls 5.1 and 5.2 of the roll system 5. The servo-motor 7.2 also drives by means of a transmission 7.4 the pair 6 of rolls 6.1 and 6.2 of the funnel or condenser T. The drive of the rotating sliver can 13, located at the outlet side of the draw frame 100, can be accomplished either by an intermediate drive 7.5 (transmission) driven by the servo-motor 7.2 or, according to a further embodiment of the draw frame 100, by means of an independent drive motor 7.5.

The drive concept is predicated upon independently driving at least one drive group within the draw frame 100 by means of a regulated drive motor. A respective regulated drive motor can be provided for each independent drive group of a drafting zone or, depending upon requirements, also a conveying or transport zone or other process-coupled drive stations. In the exemplary embodiment under discussion there are provided the two regulated drive motors 7.1 and 7.2 of the preliminary drafting zone 11 and the main drafting zone 12, respectively. Basically, there can be compensated disturbances which are caused by the drives within the framework of the entire system regulation, that is, the main regulation. However, it has been found to be advantageous to regulate each drive group itself, that is to say, to provide an intermeshed or interlinked regulation with appropriate regulators or controllers 7.1 and 7.2. What is particularly decisive is the fact that the occurring regulation deviations of the total system are advantageously influenced and there are obtained better time dependencies and possible disturbances are pre-compensated. Such drive units which are regulated with the aid or regulators 8.1 and 8.2 can be employed in different main regulation concepts.

The drive of the draw frame 100 is regulated at two levels, a superordinate main regulation by means of the lines or paths 9*a*, 9*b*, 10*a* and 10*b*, in which the central computer or control unit 10 assumes an appreciable function, and at least one subordinate auxiliary regulation by means of the regulator 8.2 for the main draft or drafting zone 12. In the embodiment under discussion, there are provided two regulators or controllers 8.1 and 8.2 for the auxiliary regulation of both the main drafting zone 12 including the outfeed region and also the preliminary drafting zone 11 including the infeed region. In the previously referred to additional embodiments, there also can be possibly provided additional regulators or controllers 8.3 and 8.5 which have been depicted with broken lines in FIG. 2. Position regulators are preferably used in conjunction with both of the servo-motors and which, for example, can be constructed as brushless direct-current motors. By virtue of the interlinked regulation with a main regulation and at least one auxiliary regulation there is relieved the central computer or control unit 10 and there is reduced the danger of there occurring large surges during the main regulation.

The main regulation which is accomplished by the previously considered structure 9*a*, 9*b*, 10*a* and 10*b*, delivers set or reference values, for example, set speed or velocity values by means of the lines or paths 10*a* and 10*b* to the main drive motors or servo-motors 7.1 and 7.2, respectively, which have been computed from the set cross-section of the emerging sliver 19 and the measured actual cross-sections of the infed slivers, that is, the cross-sections of the infed slivers 15.1 to 15.6 as determined by the measuring element 9.1 delivering an appropriate signal via the line or path 9*a* to the central computer or control unit 10 and the cross-section of the emerging sliver 19 as determined by the measuring element 9.2 delivering an appropriate signal via the line or path 9*b* to the central computer or control unit 10. Depending upon the design or lay-out of the regulation further parameters can be taken into account.

By means of the auxiliary regulations performed by the structure 8*a* to 8*k* there are regulated the speeds of the individual drive or servo-motors 7.1 and 7.2 (in the case of the modified embodiments also the speeds of the drive or servo-motors 7.3 and 7.5) in the closed position-regulator circuits 8*a*, 8*b* and 8*c* and 8*d*, respectively, (in the case of the modified embodiments also the position regulator-circuits 8*f*, 8*g* and 8*i*, 8*j*) to the set or reference values required by the upper or superordinate regulation level. Differences between the actual and set values of the motor speeds are transmitted between the position regulators 8.1 and 8.2 by means of a control connection or path 8*e* (in the case of the modified embodiments also the control connections or paths 8*k* and 8*h*). It is possible to ensure that a deviation between set value and actual value of the speed of a relevant motor which lies outside the regulation range of the relevant regulator 8.1 and 8.2 (in the case of the modified embodiments also the regulators 8.3 and 8.5) can be compensated by the position regulators of the other motors by appropriate correction of the set values for the speeds of the other motors. In this case there can be provided appropriate feedbacks to the central computer or control unit 10. According to a preferred embodiment, such correction is accomplished internally of the corresponding regulators.

The drive motors governing the drafts of the textile material, each form in conjunction with their associated regulator circuits or loops, a respective position-regulated drive system. Furthermore, each drive motor can be equipped with an encoder or resolver which delivers at any point in time with a predetermined accuracy the angular position of the drive shaft as an actual value to the position regulation for this drive motor. By means of these position regulation circuits, the control of the draw frame can mutually coordinate the angular positions of the motor shafts and thus the rolls of the drafting arrangement driven thereby.

Such a drive system renders possible an appreciably improved draft accuracy in comparison to that attainable with speed-regulated motors. Furthermore, the use of position regulators as auxiliary regulation (not rotational speed regulators), as contemplated by the present invention, simultaneously also affords the advantage that the regulation is ensured even during standstill of a motor. During the respective run-up-to-speed and braking of the draw frame there have been found to exist advantages since there is possible an appreciably improved regulation accuracy during low rotational speeds up to standstill.

As regulator or controller there are employed, within the framework of the auxiliary regulation, position regulators according to the present invention, since even in the event of standstill of the relevant drive motor such ensure the regulation. The corresponding regulators 8.1 and 8.2 (or possibly provided further regulators as contemplated for the modified embodiments as previously discussed) can contain separate computer or control units, for example, equipped with digital signal processors or micro-processors, or, however, can be designed as modules of the central computer or control unit 10.

The drive concept is predicated upon the teaching of separately regulating independent drive units or groups of the draw frame. As a drive group there is understood a unit which contains at least one drive motor including the thereby driven rolls, that is, the guide or transport rolls. In the embodiment of FIG. 2, such a drive group is constituted, for example, by the group 7.2, 7.4, 7.5, 5 and 6 containing the drive motor 7.2. A preferred embodiment of the draw frame 100 contemplates a digital synchronous control of the drive groups for the nominal settings. In this regard, one drive group serves as master drive. The regulation of a drive group then can be achieved by changing the nominal setting.

Consequently, it is possible to input from the total regulation system only the set or reference value for the adjustment or setting magnitude, that is to say, the value or a correction magnitude for the draft. Apart from such, there is to be taken into account that by means of the main regulation there should be compensated both short-term as well as slow disturbances. The depicted drive system renders possible an interlinked or intermeshed regulation and thus utilizes the improved time-dependency. The control connections or paths 8*e*, 8*h* and 8*k* likewise render possible shorter reaction times of the system. Divergences of the drive systems need not be first detected by means of a closed main regulation circuit having corresponding dead-time.

Appreciable advantages prevail for such separate regulation of each drive group particularly also then when there are provided a plurality of draft zones, of which, however, only one or only a part should or must be regulated. Those drafting zones with constant draft can be operated with merely set value input without requiring a regulation by means of the main regulation.

The regulation principle depicted in FIGS. 1 and 2 affords an extremely good evening or leveling of the slivers even in the event of unexpected changes in the operating conditions. Within the framework of such regulation there can be optimumly compensated short-term disturbances as well as slow changes. The adjustment or setting magnitudes determined by a main or primary regulation, here, for example, for the main draft, serves as input magnitude for the corresponding regulator or controller 8.2.

Figure 3:
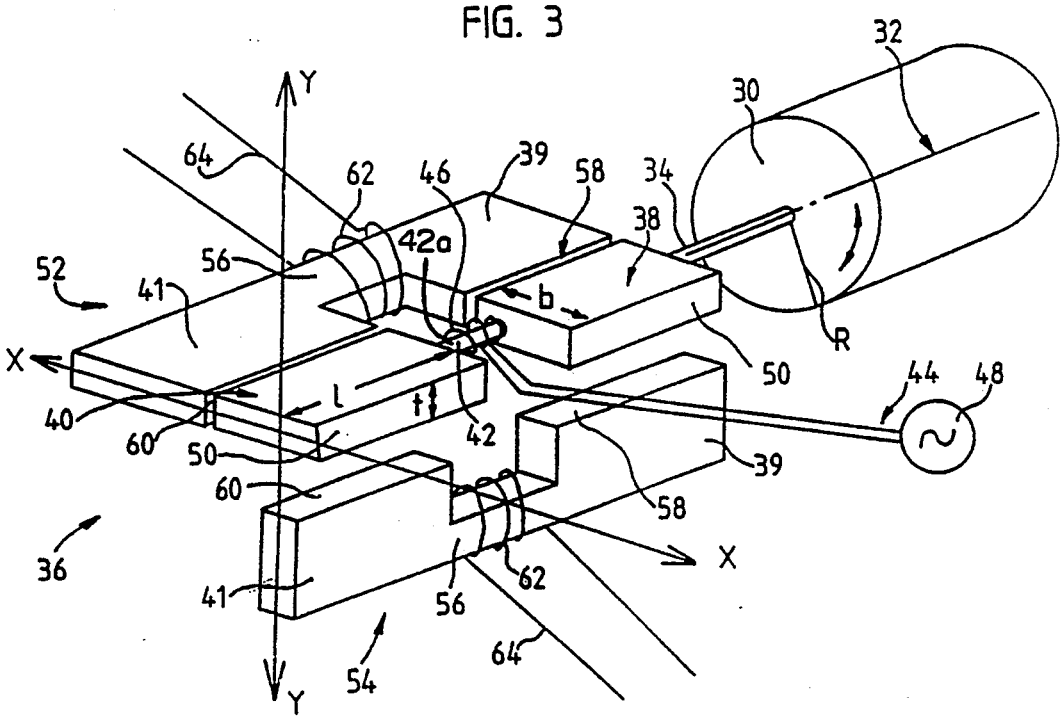
FIG. 3 schematically illustrates a position sensor for a regulation circuit according to the present invention.

FIG. 3 schematically depicts a position sensor for use in the closed regulation circuits or paths 8*a*, 8*b* and 8*c*, 8*d* of FIGS. 1 and 2. Reference numeral 30 designates the armature of, for instance, drive or servo-motor 7.1 of FIG. 1. With appropriate current excitation of the stator windings (not shown) of the drive or servo-motor 7.1, the motor armature 30 rotates about its own lengthwise axis 32 defining an axis of rotation. The motor armature 30 is connected with a shaft 34 which carries a position sensor 36. This position sensor 36 comprises a field-generating element embodying two "shoes" 38 and 40 formed of ferromagnetic material, for instance steel, or else a material possessing appropriate field-influencing properties. The shoe 38 is directly mounted upon the shaft 34, whereas the other shoe 40 is carried by the shoe 38 by means of an intermediate element 42, such as a bolt 42*a* or equivalent structure.

A line or conductor 44 for electrical current bears by means of a number of windings or turns 46 upon the intermediate element 42. Upon supplying current to the line or conductor 44 from a suitable power source 48, an electromagnetic field is generated in the intermediate element 42 which is then affected by the shoes 38 and 40 in order to configure in a predetermined manner the electromagnetic field formed in the neighboring space.

The electromagnetic field produced by the windings or turns 46 in the intermediate element 42 in the form of the bolt 42*a*, is rotationally symmetrical. The rotational symmetry is eliminated by the shape of the shoes 38 and 40 upon transition of the electromagnetic field from the bolt 42*a* to the shoes 38, 40. Each shoe 38 and 40 is configured as a flat element having a depth t which is appreciably smaller than the axial length 1 and the width b of such flat element. The effect of this flat shape of the shoes 38 and 40 is that upon transition of the electromagnetic field from the bolt 42*a* to the shoes 38 and 40 the electromagnetic field preferably widens in directions which lie within such shoe. This means that the electromagnetic field has preferred directions which have been schematically indicated in FIG. 3 by the arrow X. These directions are considered preferred in the sense that upon rotation of the shoes 38 and 40 about the lengthwise axis 32 of the motor armature 30, the electromagnetic coupling with a field-sensitive element is much greater in the directions X than in the directions Y which are perpendicular to the directions X.

Each shoe 38 and 40 has two surfaces 50 which are directed radially outwardly, of which in FIG. 3 there is only visible one surface 50 for each shoe 38 and 40. Upon rotation of the motor armature 30, and thus, the shoes 38 and 40 about the lengthwise axis 32 each pair of surfaces 50 describes a round-circular cylinder which is designated hereinafter as "jacket". Two field-sensitive elements 52 and 54 adjoin as closely as possible at the jacket of the shoes 38 and 40. Each field-sensitive element 52 and 54 comprises two shoes 39 and 41 and a connection rod or bar 56. Each shoe 39 has a surface 58 which in its form and dimensions corresponds to the surfaces 50 of the shoe 38 and merges as closely as possible at the jacket of the shoe 38. In similar fashion, each shoe 41 has a surface 60 which corresponds in its form and dimensions to the surfaces of the shoe 40 and merges as close as possible to the jacket of the shoe 40. The surfaces 58 and 60 of the field-sensitive element 52 are, however, disposed substantially perpendicular to the surfaces 58 and 60 of the field-sensitive element 54. This means that the electromagnetic coupling between the shoes 38 and 40 and the field-sensitive element 52 reaches a maximum intensity at that point in time when the electromagnetic coupling between the shoes 38 and 40 and the field-sensitive element 54 possesses a minimum intensity.

Figure 4:
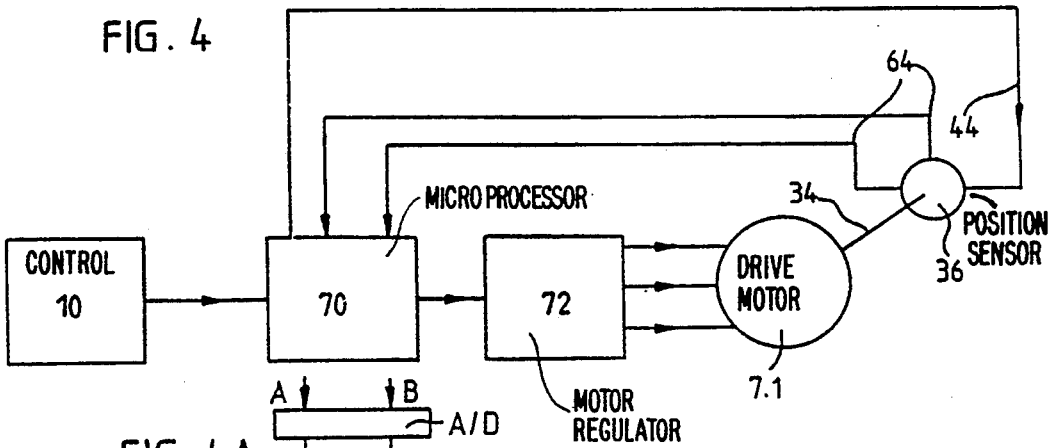
FIG. 4 schematically illustrates the regulation circuit equipped with a position sensor according to FIG. 3.

Windings 62 of respective signal lines 64 are located about the connection rods or bars 56 of the field-sensitive elements 52 and 54. These windings or turns 62 transmit the output signals of the field-sensitive elements 52 and 54 to an evaluation device, such as the microprocessor depicted in FIG. 4. The signal intensity in the signal line 64 of the field-sensitive element 52 is thus at a peak at the same time that the signal intensity in the signal line 64 of the field-sensitive element 54 has reached a minimum value and vice versa.

It is now assumed that the power source 48 produces an alternating-current voltage having a sinusoidal wave shape. The alternating current flowing through the windings 46 produces an electromagnetic field in the bolt 42*a* and in the shoes 38 and 40. By means of the pair of shoes 39 and 41 the electromagnetic field is coupled with both output lines or conductors 64, so that the input signal of the power source 48 excites an output signal which is composed of two components, namely, a first signal component in the line or conductor 64 of the field-sensitive element 52 and a second signal component in the line or conductor 64 of the field-sensitive element 54. However, the signal intensity of these two signal components is not only a function of time (depending upon the input signal generated by the power source 48), rather is also a function of the angular position of the shoes 38 and 40 about the lengthwise axis 32 of the motor armature 30, and specifically according to the following equations:

$$A = \sin \phi \sin \omega t$$

$$B = \cos \phi \sin \omega t$$

wherein,

A and B constitute both of the output signal components; $\phi$ constitutes a measure for the angular positions of the shoes; and $\omega t$ represents the conventional characteristic values for a sinusoidal wave.

Since both components A and B of the output signal are directly dependent upon the input signal, it is possible with a suitable evaluation to filter out the influence of the input signal and to obtain a signal which is only a function of the angular position of the shoes 38 and 40. However, since the carrier wave of the input signal generated by the power source 48 is time-variable, the two components A and B of the output signal also appear in the lines 64 when the motor armature 30 and thus the shoes 38 and 40 are at standstill. This means that the angular position (the position) of the shoes 38 and 40 also then can be derived by the evaluation when the drive motor with the armature 30 is not energized.

If the position of an object can be determined at any point in time and can be represented by a suitable signal, the possibility exists, upon change of this position, through the formation of a differential function to derive the velocity of the movement, in the case of a rotational movement to derive the rotational speed of the movement. This derivation of the movement velocity or rotational speed also can be accomplished in the evaluation which will be considered in conjunction with FIG. 4.

FIG. 4 again shows the drive or servo-motor 7.1 and schematically the position sensor 36 with the connection shaft 34 and both of the output lines 64. Both of these output lines 64 deliver their signals to a respective input of a microprocessor 70. This microprocessor 70 receives a further input signal from the central computer or control unit 10 (see also FIG. 1) and delivers a control signal to a motor regulator 72. Based upon the supplied control signal the motor regulator 72 determines the power available for the drive motor 7.1.

Figure 4A:
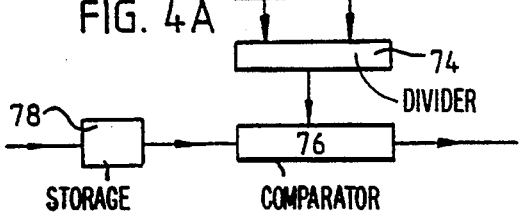
FIG. 4A schematically illustrates operations in terms of hardware performed by the microprocessor of the arrangement of FIG. 4.

The operations performed by the microprocessor 70 are determined by the programming of the microprocessor 70. For the purpose of explaining these operations there are, however, depicted the main steps graphically in the showing of FIG. 4A as "hardware elements". Accordingly, both of the signal components A and B delivered by the position sensor 36 are converted by an analog-to-digital converter A/D into corresponding digital signals and delivered to a divider 74. The divider 74 forms, for instance, the magnitude tan $\phi$ and delivers the corresponding signal to a comparator 76. This momentary (actual) value for the angular position of the shoes 38 and 40 is compared with a set or reference value in the comparator 76 and which is available in a suitable storage 78. Any possible difference (deviation) between the set value and the actual value is represented by the comparator 76 in the form of a deviation signal and delivered to the motor regulator 72 for control of the motor output.

The set value in the storage 78 can be changed as a function of the programming, and specifically as a function of a program course determined in the central computer or control unit 10 and from the machine settings inputted to the central computer or control unit 10. An example of a program course has been schematically depicted in FIGS. 5 and 6.

Figure 5:
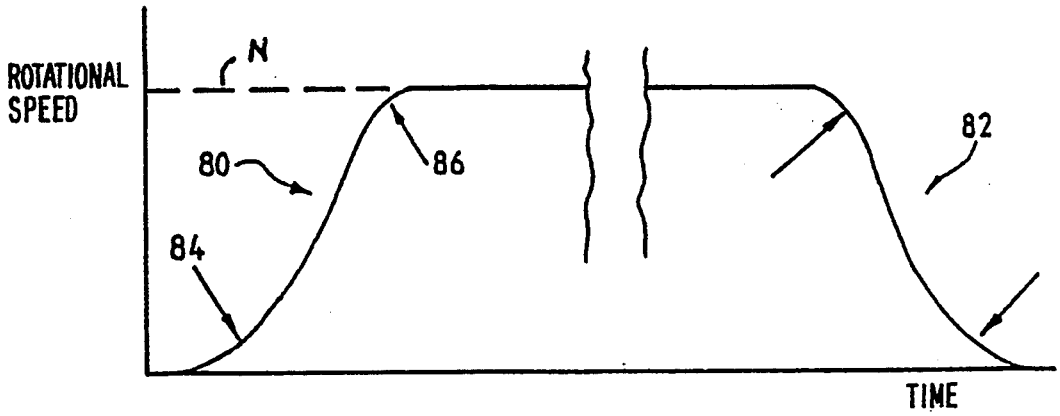
FIG. 5 illustrates run-up-to-speed and braking curves for a draw frame according to the present invention.
Figure 6:
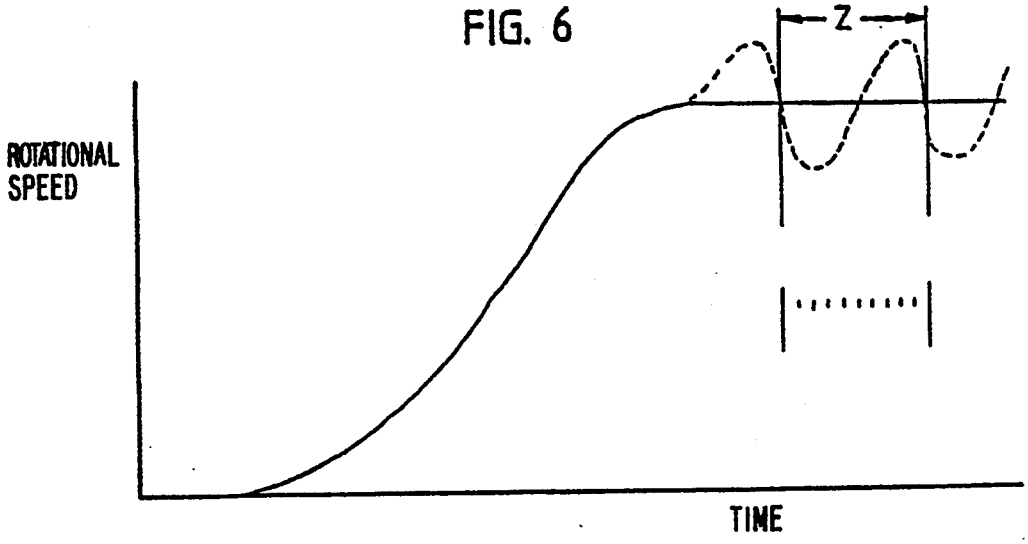
FIG. 6 illustrates a diagram for explaining the requirements imposed upon the evaluation of a regulation circuit according to the present invention.

FIG. 5 depicts the run-up-to-speed 80, from standstill, to a constant operating speed or velocity N and the subsequent braking 82 down to standstill. The normal operation is essentially omitted from the fragmented or broken away central portion of the graph of FIG. 5 since this normal operating condition has no significance in conjunction with FIG. 5. The relevant considerations will be described hereinafter in connection with the run-up-to-speed 80, and such considerations are also applicable with regard to the braking 82 to standstill.

What is desired is a starting or run-up-to-speed curve having a controlled transition 84 from standstill, a central portion of constant slope (constant acceleration) and a controlled transition 86 to the operating rotational speed N. The constant slope of the central portion of this characteristic curve and the controlled transition 86 to the operating rotational speed N, at the present time do not pose any particular problems, even for prior art systems. However, problems arise during the transition 84 from standstill. In this connection a position regulation of the drive motor is insufficient if the formation of an output signal by the position sensor of this regulation is dependent upon a rotational movement of the motor armature. It is then practically impossible to accurately follow the "position" of the armature during standstill. The position sensor 36 schematically depicted in FIG. 3 is, however, not dependent upon relative movement of the shoes 38 and 40 in relation to the field-sensitive elements 52 and 54 for generating an output signal. This position sensor 36 also then delivers a position signal when the motor armature 30 is at standstill. There also can be derived by the position sensor 36 a rotational speed-dependent signal even with the lowest rotational speeds of the motor armature 30 by virtue of the corresponding changes in the output signal.

Therefore, the present invention renders possible the exact regulation of the rotational speed of the drive motor during the run-up-to-speed and the braking and affords appropriate advantages even when there is only present a single motor. However, the present invention is particularly advantageous when there are used two or more drive motors (see FIG. 1) and there should be maintained an exact rotational speed ratio or relationship between these drive motors throughout all operating conditions, that is to say, also during common run-up-to-speed phases and braking phases. As is well known this is the case for draw frames.

In FIG. 5 it has been assumed that it is only necessary to implement a pre-programmed running or speed characteristic. In practice this holds true for a drive group (roll group) which runs at a constant rotational speed during normal operation. In an autoleveller draw frame the rotational speed of at least one drive group must be, however, alterable also after reaching the programmed rotational speed N in order to compensate mass fluctuations in the processed fiber sliver by performing changes in drafting of the textile material. This has been schematically depicted in FIG. 6, wherein there has been assumed for the sake of simplicity a sinusoidal change (depicted in broken or chain line) of the rotational speed of the relevant drive group about the operating rotational speed N. An autoleveller draw frame which also should compensate or level out short-term mass fluctuations at delivery speeds of at least 800 m/min., must be able to carry out sinusoidal rotational speed changes, as depicted in broken lines in FIG. 6, with a cycle of maximum 3 milliseconds. In order to ensure for such with a closed regulation circuit according to FIG. 4, the scanning rate of the A/D-converter should amount to at least 3 kHz, so that each cycle Z (FIG. 6) of an (imaginary) sinusoidal rotational speed change can be scanned or sampled at least ten times and compared with an appropriate set or reference value.

An arrangement according to FIG. 3 delivers a position signal which corresponds to the angular position of a random radius at the motor armature 30 (for example, the radius R, FIG. 3) with an indeterminateness of $\pm 180°$, that is to say, based upon a position signal from the position sensor 36 it is not possible to determine if the radius R is located in the depicted position or in a diametrically opposite position. The differentiation between these two possibilities is not necessary for a draw frame regulation. However, if for a certain case or field of application such appears to be significant, then with appropriate design of the electromagnetic field generator (the shoes 38 and 40) and with an appropriate matching or tuning of the field-sensitive elements 52 and 54, there can be obtained a position signal which indicates both the direction as well as the angular position of a reference vector on the motor armature.

While there are shown and described present preferred embodiments of the invention, it is distinctly to be understood the invention is not limited thereto, but may be otherwise variously embodied and practiced within the scope of the following claims.

What is claimed is:

1. A regulated drive for a drafting arrangement, said regulated drive comprising:

a regulated drive motor being operatively connected to drive a drive shaft for driving at least a portion of said drafting arrangement;

a regulation circuit for regulating said regulated drive motor;

position determining means for determining an angular position of said drive shaft within said drafting arrangement, while said drive shaft is at a standstill, and for generating a standstill position signal which indicates said angular position, while said drive shaft is at a standstill;

said regulation circuit comprising means for monitoring said standstill position signal after stopping said drive motor and before starting said drive motor, and means for regulating said regulated drive motor as a function of the monitored standstill position signal; and said drafting arrangement comprising means for regulating mass fluctuations of textile material processed by the drafting arrangement.

2. The regulated drive according to claim 1, further comprising an evaluation device for deriving a rotational-speed-dependent signal from detected changes in the angular position of said drive shaft as determined by said position determining means.

3. The regulated drive according to claim 2, further comprising means for processing digital signals, and means for converting an analog position signal produced by said position determining means into a digital position signal.

4. The regulated drive according to claim 1, wherein said position determining means comprises a position sensor, said position sensor comprising:

a field-generating system;

a field-sensitive system; and means for transmitting electromagnetic energy from the field-generating system to the field-sensitive system.

5. The regulated drive according to claim 4, wherein:

said regulated drive motor comprises a motor armature having an axis of rotation; and said field-sensitive system comprises at least two field-sensitive elements distributed about an axis of rotation of said motor armature.

6. The regulated drive according to claim 4, further comprising:

an evaluation circuit device for deriving a rotational-speed-dependent signal from changes in the angular position of said drive shaft as determined by said position determining means.

7. The regulated drive according to claim 6, wherein said evaluation circuit device comprises means for processing digital signals, and means for converting an analog position signal into a digital position signal.

8. The regulated drive according to claim 7, wherein said means for converting comprises an analog-to-digital converter having a scanning frequency greater than 2500 Hz.

9. The regulated drive according to claim 4, wherein:

said regulated drive motor comprises a plurality of associated regulated drive motors each having a motor armature;

said regulation circuit comprises a respective regulation circuit for regulation of each associated regulated drive motor; and each respective regulation circuit comprises a respective position sensor for delivering a position signal corresponding to an angular position of a motor armature of the associated regulated drive motor while the motor armature is at a standstill.

10. The regulated drive according to claim 9, wherein the respective regulation circuits comprise common control means for determining a predetermined mutual operational sequence of the associated regulated drive motors.

11. The regulated drive according to claim 1, further comprising said drafting arrangement, said drafting arrangement comprising a draw frame connected to said drive shaft, whereby said draw frame is moved when said drive shaft is rotated by said regulated drive motor.

12. The regulated drive according to claim 11, wherein:

said drafting arrangement further comprises drafting rolls for drafting a fiber web; and said drive motor comprises means for driving said drafting rolls.

* * * * *